US008888252B2

(12) United States Patent
Bhowmik et al.

(10) Patent No.: US 8,888,252 B2
(45) Date of Patent: Nov. 18, 2014

(54) PRINT HEAD SLOT RIBS

(75) Inventors: Siddhartha Bhowmik, Salem, OR (US); Swaroop K. Kommera, Corvallis, OR (US); Manish Giri, Corvallis, OR (US); Robert N. K. Browning, Corvallis, OR (US); Charles Gustav Schmidt, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 354 days.

(21) Appl. No.: 12/993,848

(22) PCT Filed: Jul. 9, 2008

(86) PCT No.: PCT/US2008/069570

§ 371 (c)(1),
(2), (4) Date: Nov. 22, 2010

(87) PCT Pub. No.: WO2010/005434

PCT Pub. Date: Jan. 14, 2010

(65) Prior Publication Data

US 2011/0069120 A1 Mar. 24, 2011

(51) Int. Cl.
*B41J 2/14* (2006.01)
*B41J 2/16* (2006.01)

(52) U.S. Cl.
CPC ..... *B41J 2/1601* (2013.01); *B41J 2/14145* (2013.01); *B41J 2/1623* (2013.01); *B41J 2/1628* (2013.01); *B41J 2/1629* (2013.01); *B41J 2/1634* (2013.01)
USPC ..... 347/65

(58) Field of Classification Search
None
See application file for complete search history.

(56) References Cited

U.S. PATENT DOCUMENTS

| | | | |
|---|---|---|---|
| 4,875,968 | A | 10/1989 | O'Neill et al. |
| 5,317,346 | A | 5/1994 | Garcia |
| 5,440,124 | A | 8/1995 | Kelly et al. |
| 5,608,436 | A | 3/1997 | Baughman et al. |
| 6,540,337 | B1 | 4/2003 | Pollard |
| 6,672,712 | B1 | 1/2004 | Donaldson et al. |
| 6,830,319 | B2 | 12/2004 | Harajiri et al. |
| 6,930,055 | B1 | 8/2005 | Bhowmik et al. |
| 7,083,268 | B2 | 8/2006 | Obert et al. |
| 2003/0025754 | A1 | 2/2003 | Mou et al. |
| 2003/0058309 | A1 | 3/2003 | Haluzak et al. |
| 2004/0055145 | A1 | 3/2004 | Buswell |
| 2005/0236358 | A1 | 10/2005 | Buswell |
| 2006/0192815 | A1 | 8/2006 | Donaldson |
| 2007/0210031 | A1 | 9/2007 | Clarke et al. |
| 2007/0259463 | A1 | 11/2007 | Abedini |
| 2008/0007598 | A1 | 1/2008 | Hong |

FOREIGN PATENT DOCUMENTS

WO 03036737 5/2003

OTHER PUBLICATIONS

Supplementary European Search Report for Application No. EP08781582. Report issued Jul. 22, 2011.

*Primary Examiner* — Jerry Rahll

(57) ABSTRACT

A print head die (30) includes slot ribs (41) having edges (62, 64) with triangular notches. In one embodiment, the print head die is formed by dry etching from a first side (50) of a wafer (30) a series of spaced openings (220) completely through the wafer (30) and separated by ribs (41) followed by wet etching the wafer (30) from a second opposite side (44) to recess the ribs (41) from the second side (44).

20 Claims, 8 Drawing Sheets

30
50
200
210
44
208
211
212
9B
10B
40
41
220
62
64
70
11B
11C
8B 210
371
373

208
371
211
330
373
50
210

210
220
208
375

210
375
341
208

210
13B
13C
330
208
50
30
13B
13C 44
210
50
40

33
46
341
44
70
210
362
50

30
14B
14C
330
210
50
14B
14C

PRINT HEAD SLOT RIBS

BACKGROUND

Print head dies support fluid ejection components of a print head and provide a fluid passage from a fluid reservoir to such components. Increasing a density of fluid passages through the die may reduce strength of the die. Current efforts to strengthen the die may reduce print quality and increase fabrication cost of the die. In particular, current rib strengthening efforts cause unwanted secondary problems such as banding, wicking of adhesive material into slots during fabrication, and trapping of air bubbles along the ribs during printing.

DETAILED DESCRIPTION OF THE EXAMPLE EMBODIMENTS

Figure 1:
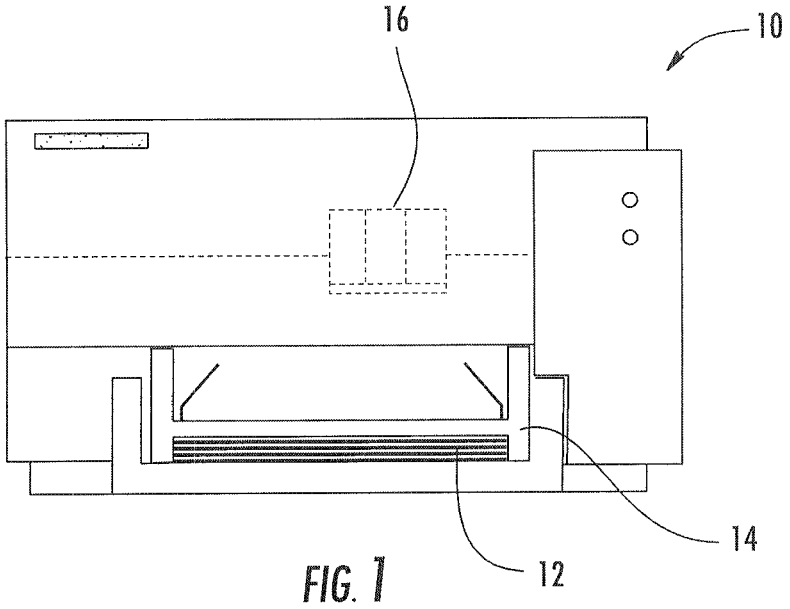
FIG. 1 is a front elevational view of a printer according to an example embodiment.

FIG. 1 illustrates one example of a printing device 10 according to an example embodiment. Printing device 10 is configured to print or deposit ink or other fluid onto a print media 12, such as sheets of paper or other material. Printing device 10 includes a media feed 14 and one or more print cartridges 16. Media feed 14 drives or moves media 12 relative to cartridges 16 which eject ink or fluid onto the medium. In the example illustrated, cartridges 16 are driven or scanned transversely across media 12 during printing. In other embodiment, cartridges 16 maybe stationary and may extend substantially across a transverse width the media 12. As will be described hereinafter, print cartridges 16 include print head dies that have relatively high density of fluid passages, vias or slots while exhibiting enhanced strength and facilitating relatively high print quality.

Figure 2:
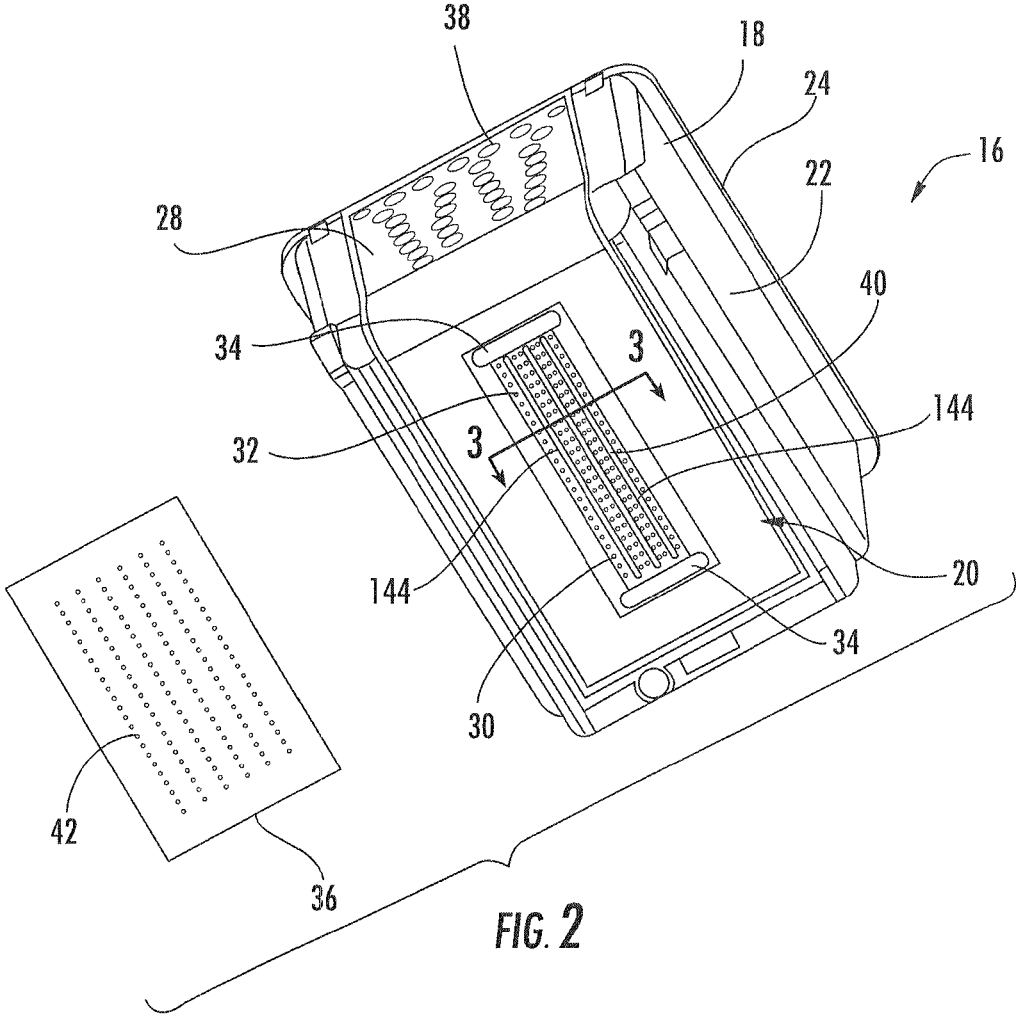
FIG. 2 is an exploded bottom perspective view of a print cartridge of the printer of FIG. 1 according to an example embodiment.

FIG. 2 illustrates one of cartridges 16 in more detail. As shown by FIG. 2, cartridge 16 includes fluid reservoir 18 and head assembly 20. Fluid reservoir 18 comprises one or more structures configured to supply fluid or ink to head assembly 20. In one embodiment, fluid reservoir 18 includes a body 22 and a lid 24 which form one or more internal fluid chambers that contain fluid, such as ink, which is discharged through slots or openings to head assembly 20. In one embodiment, the one or more internal fluid chambers may additionally include a capillary medium (not shown) for exerting a capillary force on the printing fluid to reduce the likelihood of the printing fluid leaking. In one embodiment, each internal chamber of fluid reservoir 18 may further include an internal standpipe (not shown) and a filter across the internal standpipe. In yet another embodiment, fluid reservoir 18 may have other configurations. For example, although fluid reservoir 18 is illustrated as including a self-contained supply of one or more types of fluid or inks, in other embodiments, fluid reservoir 18 may be configured to receive fluid or ink from an off-axis of fluid supply via one or more conduits or tubes.

Head assembly 20 comprises a mechanism coupled to a fluid reservoir 18 by which the fluid or ink is selectively ejected onto a medium. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

In the embodiment illustrated, head assembly 20 comprises a drop-on-demand inkjet head assembly. In one embodiment, head assembly 20 comprises a thermoresistive head assembly. In other embodiments, head assembly 20 may comprise other devices configured to selectively deliver or eject printing fluid onto a medium.

In the particular embodiment illustrated, head assembly 20 comprises a tab head assembly (THA) which includes flexible circuit 28, print head die 30, firing resistors 32, encapsulate 34 and orifice plate 36. Flexible circuit 28 comprises a band, panel or other structure of flexible bendable material, such as one or more polymers, supporting or containing electrical lines, wires or traces that terminate at electrical contacts 38 and that are electrically connected to firing circuitry or resistors 32 on die 30. Electrical contacts 38 extend generally orthogonal to die 30 and comprise pads configured to make electrical contact with corresponding electrical contacts of the printing device in which cartridge 16 is employed. As shown by FIG. 2, flexible circuit 28 wraps around body 22 of fluid reservoir 18. In other embodiments, flexible circuit 28 may be omitted or may have other configurations where electrical connection to resistors 32 and their associated addressing or firing circuitry is achieved in other fashions.

Print head die 30 (also known as a print head substrate or chip) comprises one or more structures coupled between the interior fluid chamber of the reservoir 18 and resistors 32. Print head die 30 delivers fluid to resistors 32. In the particular embodiment illustrated, print head die 30 further supports resistors 32 (schematically shown). Print head die 30 includes slots 40 and ribs 41 (shown in FIG. 3). The slots 40 comprise fluid passages or fluid via through which fluid is delivered to resistors 32. Slots 40 have a sufficient length to deliver fluid to each of resistors 32 and their associated nozzles. In one embodiment, slots 40 have a width of less than or equal to about 300 micrometers and nominally about 200 micrometers. In the embodiment illustrated in which firing circuitry or resister addressing circuitry is directly provided upon or as part of the chip or die 30, slots 40 have a centerline-to-centerline pitch of approximately 0.8 mm. In embodiments where the firing or addressing circuitry is not provided upon the chip or die 30, slots 40 may have a centerline-to-centerline pitch of approximately 0.5 mm. In other embodiments, slots 40 may have other dimensions and other relative spacings.

Ribs 41 (also known as cross beams) comprise reinforcement structures configured to strengthen and rigidify those portions of print head die 30 between consecutive slots 40 (bars 64). Ribs 41 extend across each of slots 40 generally perpendicular to a major axis along which each of slots 40 extends. In one embodiment, ribs 41 and the center points of ribs 41 are integrally formed as part of the single unitary body with a majority of those portions of print head die 30 on opposite sides of slots 40. As will be described in more detail hereafter, ribs 41 strengthen die 30, permitting slots 40 to be more densely arranged across die 30, without substantially reducing print performance or quality.

Resistors comprise resistive elements or firing circuitry coupled to print head die 30 and configured to generate heat so as to vaporize portions of the printing fluid to forcibly expel drops of printing fluid through orifices in orifice plate 36. In yet other embodiment, the firing circuitry may have other configurations.

Encapsulants 34 comprise one or more material which encapsulate electrical interconnects that interconnect electrically conductive traces or lines associated with die 30 with electrically conductive lines or traces of flexible circuit 28 which are connected to electrical contacts 38. In other embodiments, encapsulates 34 may have other configurations or may be omitted.

Orifice plate 36 comprises a plate or panel having a multitude of orifices which define nozzle openings through which the printing fluid is ejected. Orifice plate 36 is mounted or secured opposite to slots 40 and their associated firing circuitry or resistors 32. In one embodiment, orifice plate 36 comprises a nickel substrate. As shown by FIG. 2, orifice plate 36 includes a plurality of orifices or nozzles 42 through which ink or fluid heated by resistors 32 is ejected for printing on a print medium. In other embodiments, orifice plate 36 may be omitted where such orifices or nozzles are otherwise provided.

Although cartridge 16 is illustrated as a cartridge configured to be removably mounted to or within printer 10, in other embodiments, fluid reservoir 18 may comprise one or more structures which are a substantially permanent part of printer 10 and which are not removable. Although printer 10 is illustrated as a front loading and front discharging desktop printer, in other embodiments, printer 10 may have other configurations and may comprise other printing devices where printer 10 prints or ejects a controlled pattern, image or layout and the like of fluid onto a surface. Examples of other such printing devices include, but are not limited to, facsimile machines, photocopiers, multifunction devices or other devices which print or eject fluid.

Figure 3:
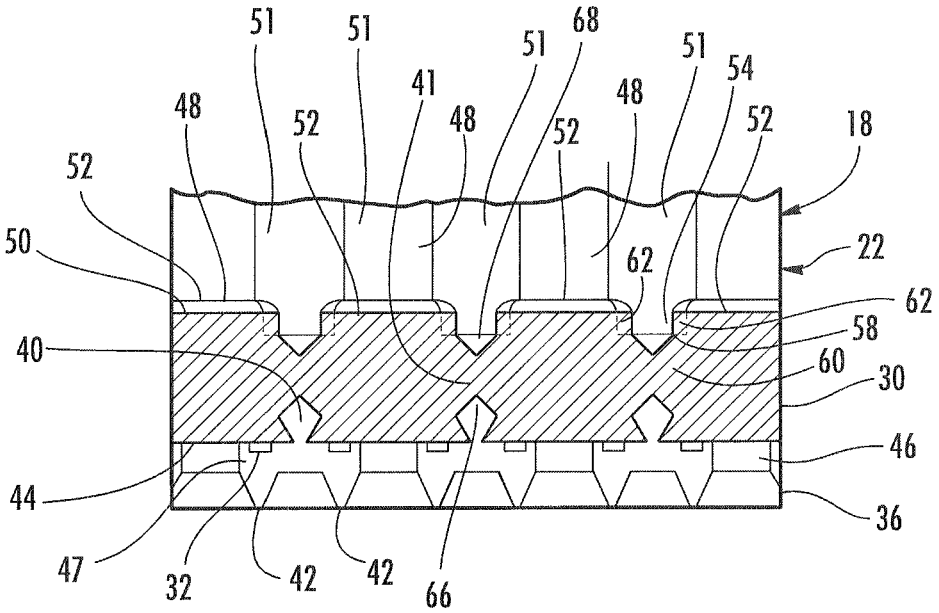
FIG. 3 is a sectional view of the cartridge of FIG. 2 taken along line 3-3 according to an example embodiment.

FIG. 3 is a sectional view illustrating head assembly 20 in detail. In particular, FIG. 3 illustrates print head die 30 coupled between a lower portion of body 22 of reservoir 18 and orifice plate 36. As shown by FIG. 3, in the example illustrated, print head die 30 has a lower or front side 44 joined to orifice plate 36 by a barrier layer 46. Barrier layer 46 at least partially forms firing chambers 47 between resistors 32 and nozzles 42 of orifice plate 36. In one embodiment, barrier layer 46 may comprise a photo-resist polymer substrate. In one embodiment, barrier layer 46 may be formed from the same material as that of orifice plate 36. In yet another embodiment, barrier layer 46 may form orifices or nozzles 42 such that orifice plate 36 may be omitted. In some embodiments, barrier layer 46 may be omitted.

As shown by FIG. 3, resistors 32 are supported on shelves on opposite sides of slots 40 and generally opposite to nozzles 42 within firing chambers 47. Resistors 32 are electrically connected to contact pads 38 (shown in FIG. 2) by electrically conductive lines or traces (not shown) supported by die 30. Electrical energy supplied to resistors 32 vaporizes fluid supply through slots 40 to form a bubble that forces or ejects surrounding or adjacent fluid through nozzles 42. In one embodiment, resistors 32 are further connected to firing or addressing circuitry also located upon die 30. In another embodiment, resistors 32 may be connected to firing or addressing circuitry located elsewhere.

As further shown by FIG. 3, body 22 of reservoir 18 includes inter-posers or headlands 48. Headlands 48 comprise those structures or portions of body 22 which are connected to die 30 so as to fluidly seal one or more chambers of reservoir 18 to a second side if of die 30. In the example illustrated, headlands 48 connect each of the three separate fluid containing chambers 51 to each of the three slots 40 of die 30. For example, in one embodiment, reservoir 18 may include three separate stand pipes which deliver fluid to each of the three slots 40. In one embodiment, each of the three separate chambers may include a distinct type of fluid, such as a distinct color of fluid or ink. In other embodiments, body 22 of reservoir 18 may include a greater or fewer number of such headlands 48 depending upon the number of slots 40 in die 30 which are to receive different fluids from different chambers in reservoir 18.

In the example illustrated, side 50 of die 30 is adhesively bonded to body 22 by an adhesive 52. In one embodiment, adhesive 52 comprises glue or other fluid adhesive. In other embodiments, headlands 48 of reservoir 18 may be sealed and joined to die 30 in other fashions.

Figure 4:
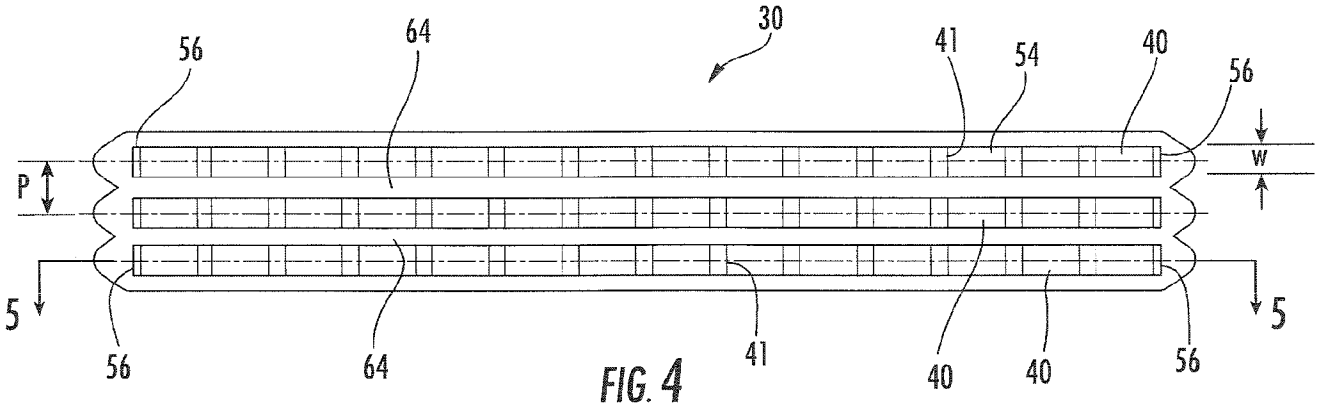
FIG. 4 is a top plan of view of a print head die of the print cartridge of FIG. 2 according to an example embodiment.
Figure 5:
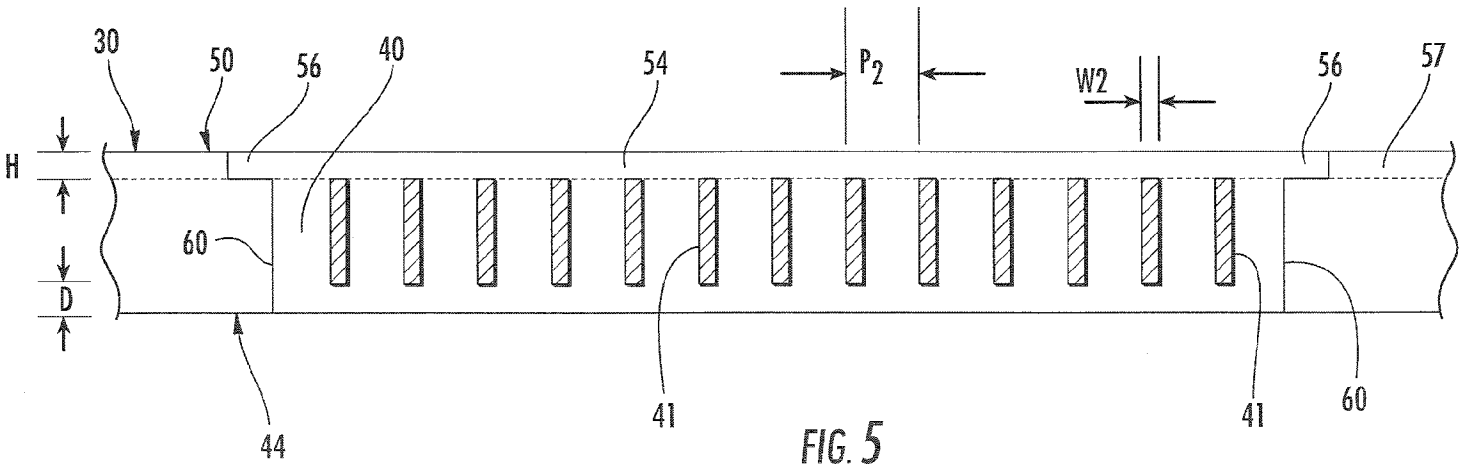
FIG. 5 is a sectional view of the print head die of FIG. 4 taken along line 5-5 according to an example embodiment.

FIGS. 4-5 illustrate slots 40 and ribs 60 of print head die 30 in detail. FIG. 4 is a plan view of print head die 30 taken from side 50. FIG. 5 is a sectional view through print head die 38 along a line 5-5 of FIG. 4. As shown by FIG. 5, portions 54 of die 30 adjacent to side 50 are counter sunk or recessed above each of ribs 41 and axially along each slot 40. As a result, each of ribs 41 is also recessed or countersunk from an outermost side or topside 50 of die 30. In addition, portions 56 adjacent to side 50 and located at axial ends of each of slots 40 are counter sunk or recessed. It is to be noted that depending on device needs, the countersink/recess, can occur on topside 50, only and process may be adjusted to make this change. As will be described hereafter, the countersunk or recessed portions 54 and 56 may be formed by either one or more material removal techniques or processes wherein material is removed to form portions 54, 56 or by one or more material additive techniques or processes wherein one or more layers of one or more materials are added adjacent to portions 54 and 56 such that portions 54 and 56 are recessed relative to the surface of the topmost added layer. For example, as indicated by broken lines in FIG. 5, countersunk portions 54 and 56 are surrounded by elevated portions 57 which extend above ribs 41 and which project above side 60 of slots 40. Such elevated portions 57 may be formed by adding material to die 30 or by removing material from die 30.

Because die 30 includes recessed or countersunk regions or portions 54, 56 along each of slots 40 (and above ribs 41) and at axial ends of slots 40, the adhesive material 52 (shown in FIG. 3) that is applied while in a fluid or viscous state to join head lands 48 to print head die 30 is less likely to wick or otherwise flow into slots 40. In particular, recessed portions 54, 56 reduce the number and area of corners 58 along face or side 50 and along slots 40. Instead, such corners 58 between ribs 41 and adjacent sides 60 of slots 40 are recessed and do not extend adjacent to or coplaner with side 50. The recessed or countersunk portions form a "capillary break" which keeps flowing adhesive from reaching the ink feed holes or slots 40. As a result, the adhesive material 52 is less likely to flow into slots 40. Thus, slots 40 are less likely to become clogged or partially blocked by adhesive extending along the sides 60 of slots 40 and projecting into the fluid passages provided by slots 40. Consequently, print head die 30 provides enhanced fluid or ink flow for enhanced print quality.

According to one embodiment, countersunk portions 54, 56 have a depth or height H (shown in FIG. 5) of between about 10μ (microns or micrometers) and about 90μ and nominally about 50 micrometers. Although it has been found that such heights reduce wicking of adhesive material 52, in other embodiments, countersunk portions 54, 56 may have other heights H. In yet another embodiment, countersunk portions 54, 56 may be employed independent of one another. For example, in one embodiment, countersunk portions 56 may be omitted. In other embodiments, countersunk portions 54 may be omitted while still providing some of the noted benefits. Although countersunk portions 54 and 56 are illustrated as both having the same height H, in other embodiments, countersunk portions 54 and 56 may have different heights H or depths from side 50.

As further shown by FIG. 5, ribs 41 are recessed from side 44 of die 30. According to one embodiment, ribs 41 are recessed or spaced from side 44 by a distance D have at least 30 micrometers and nominally about-50 micrometers. Because ribs 41 are recessed from side 44 by at least 30 micrometers, print quality is enhanced. In particular, the silicon rib 41 is heated from the heat generated by resistors 32 (shown in FIG. 3) and ink. The heated ribs in turn transfer heat locally to the adjacent ink or fluid which affects the vapor pressure and bubble characteristics of the fluid or ink. This in turn may reduce or otherwise change the size or drop weight of the fluid drop ejected during each firing. As a result, the image printed may experience dark printed bands (sometimes referred to as print banding) above the ribs. However, because ribs 41 are recessed or spaced from side 44 by a distance D of at least about 30 micrometers, ribs 41 are more greatly spaced from side 44, resisters 32 and nozzles 42. As a result, even the reduced amount of heat transferred to the fluid or ink by the ribs is permitted to spread out across the print head, lessening temperature variations between ink or fluid that is directly opposite to the ribs 61 and ink or fluid that is directly opposite to areas between consecutive ribs. By reducing temperature variations, drop weight variations are also reduced, producing a more uniform higher-quality print result.

To further enhance print quality while maintaining the strength of print die 30 (the rigidity of bars 64 between consecutive slots 40), ribs 41 have a relatively small width and a relatively small pitch. According to one embodiment, ribs 41 have a width W2 of between about 50 micrometers and about 150 micrometers. Ribs 41 have a center-to-center pitch P2 of between about 200μ and about 2000 um and nominally about 500 micrometers. By providing ribs 41 with a relatively small width and relatively small pitch, transfer of heat to fluid or ink across the area of die 30 is more uniform further reducing the likelihood of banding in the printed image. At the same time, the width of ribs 41 is sufficient to adequately rigidify and strengthen bars 64. The pitch of ribs 41 is sufficiently large and the width of ribs 41 is sufficiently narrow to reduce the likelihood of bubble entrapment and fluid flow occlusion. In other embodiments, geometries may vary depending on product needs and processing parameters.

According to one embodiment, die 30 has a thickness of about 500 micrometers. Slots 40 have a width W of about 200 micrometers and a pitch of about 0.8 mm. Likewise, ribs 41 have a length of about 200μ. Ribs 41 have a width W2 of between about 50 micrometers and about 150 micrometers and a pitch of about 350 micrometers. Ribs 41 have a height of between about 200 micrometers and 470 micrometers. Ribs 41 are recessed from face or side 50 by 0 to 300 micrometers (nominally about 50 micrometers) and are spaced or recessed from side 44 by 30 to 80 micrometers. In such an embodiment, die 30 is formed from silicon. In other embodiments, die 30 may have other feature dimensions and may be formed from other materials.

Figure 6B:
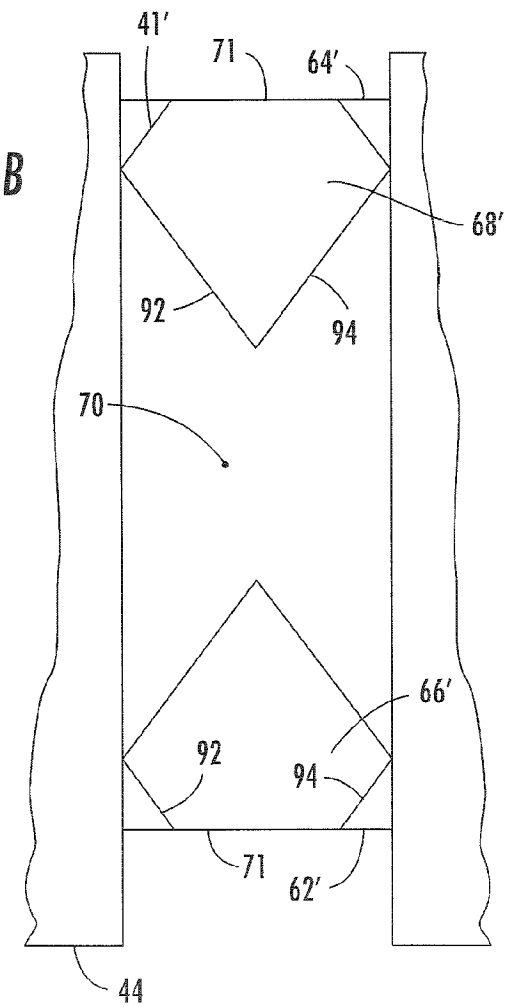
FIG. 6B is an enlarged fragmentary view of another example of a print head die.
Figure 6A:
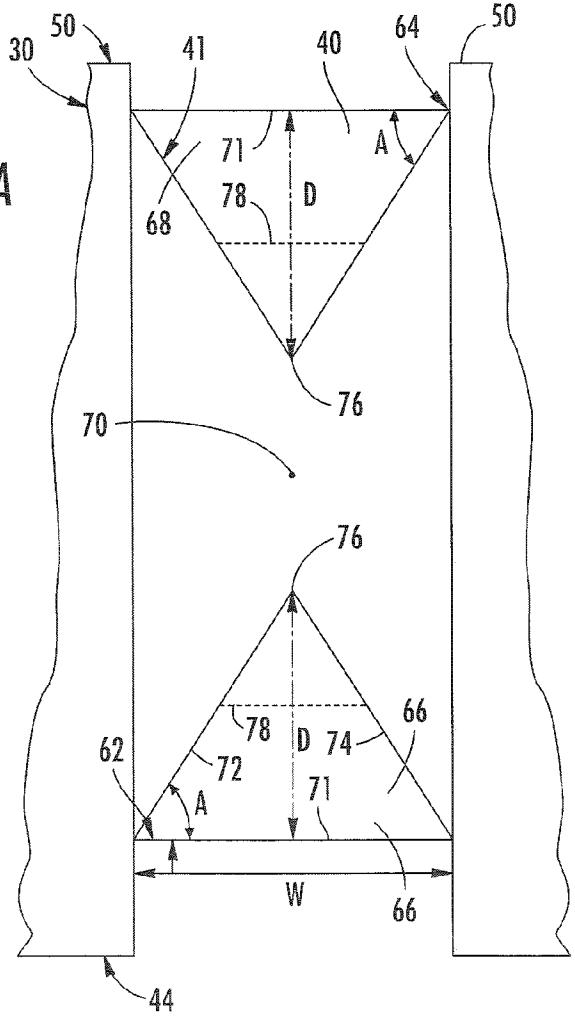
FIG. 6A is an enlarged fragmentary view of a print head die of the cartridge of FIG. 3 according to an example embodiment.

FIG. 6A is an enlarged fragmentary view illustrating one of ribs 41 of print head die 30 in more detail. As shown by FIG. 6A, each rib 41 extends across slot 40 between the sides 44 and 50 of die 30. Each rib 41 has a first edge 62 recessed from side 44 of die 30 and a second edge 64 recessed from side 50 of die 30. Each rib further includes opposing recesses 66, 68 which extend from edges 62, 64, respectively, towards one another. Substantially all of the surfaces which define recesses 66 and 68 face away from a center point 70 of the associated rib 41. In other words, all of the surfaces that form a recess 66 face away from edge 64. Likewise, all of the surfaces that form recess 68 face away from edge 62. Because there are few, if any surfaces or little of any surface area within recesses 66, 68 that face away from the openings 70 of each of recesses 66, 68, there is a less likelihood of air or air bubbles becoming trapped or retained within such recesses 66, 68 against surfaces that face away from an associated opening 71. As a result, fluid ejection performance and print quality may be enhanced. Since the ribs can be designed to be of narrow thickness (<150 um), large bubbles are not trapped here. Small bubbles, if present can still leave enough ink for resistors to fire without starvation.

In the example embodiment shown in FIG. 6A, recesses 66, 68 are substantially identical to one another. In one embodiment, recesses 66, 68 are simultaneously or concurrently formed. In the example illustrated, each of recesses 66, 68 comprises a generally triangular notch having sides 72, 74 extending from opening 71 into rib 41. Sides 72, 74 of recess 66 extend from edge 62 away from edge 62 and away from side 44 towards center point 70. Sides 72, 74 of recess 68 extend from edge 64 away from edge 64 and away from side 50 towards center point 70. In the example illustrated, sides 72, 74 each form an angle A between about 50 degrees and 60 degrees, and nominally about 54 degrees, with respect to opening 71.

In one embodiment, sides 72, 74 converge at a converging tip or point 76. In such an embodiment, recesses 66, 68 have the greatest depth without forming surfaces that face away from opening 71. As a result, the processes used to form recesses 66, 68, and which also may be used to form or modify other features of print head 30, such as the recessing of ribs 41 from side 44 or the widening of slots 40 or their openings, may be prolonged, if desired, without sacrificing subsequent fluid ejecting performance of print head 30. For example, prolonging the process that forms recesses 66 and 68 results in ribs 41 being recessed from side 44 of die 30 to a greater extent. As a result, print banding (described above) may be reduced to enhance print quality. In one embodiment, each recess 66, 68 has a depth D of approximately 93 μm and a width of approximately 93 μm. In one embodiment, ribs 41 are recessed from side 44 by distance of at least 100 μm and nominally about 175 μm.

As indicated in broken lines, in other embodiments, sides 72, 74 may terminate prior to convergence. In such an alternative embodiment, each recess 66, 68 alternatively includes a ceiling/floor 78 in place of point 76. In yet another embodiment, recesses 66, 68 may have other configurations.

Figure 7:
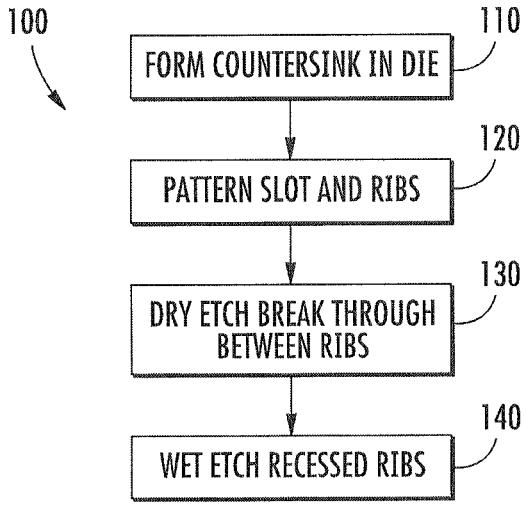
FIG. 7 is a flow diagram of a method of forming a print head die according to an example embodiment.

FIGS. 7-11 illustrate one example method of forming print head die 30. FIG. 7 is a flow diagram of a method 100 were forming print head die 30 including ribs 41 (shown in FIG. 6A). FIGS. 8-11 illustrate such steps being performed to form die 30. For ease of illustration and discussion, the formation of a single slot and associated ribs is illustrated and described. However, additional slots and associated ribs may be concurrently formed.

Figures 8A, 8B, 9A, 9B, 10A, 10B, 11A, 11B, 11C:
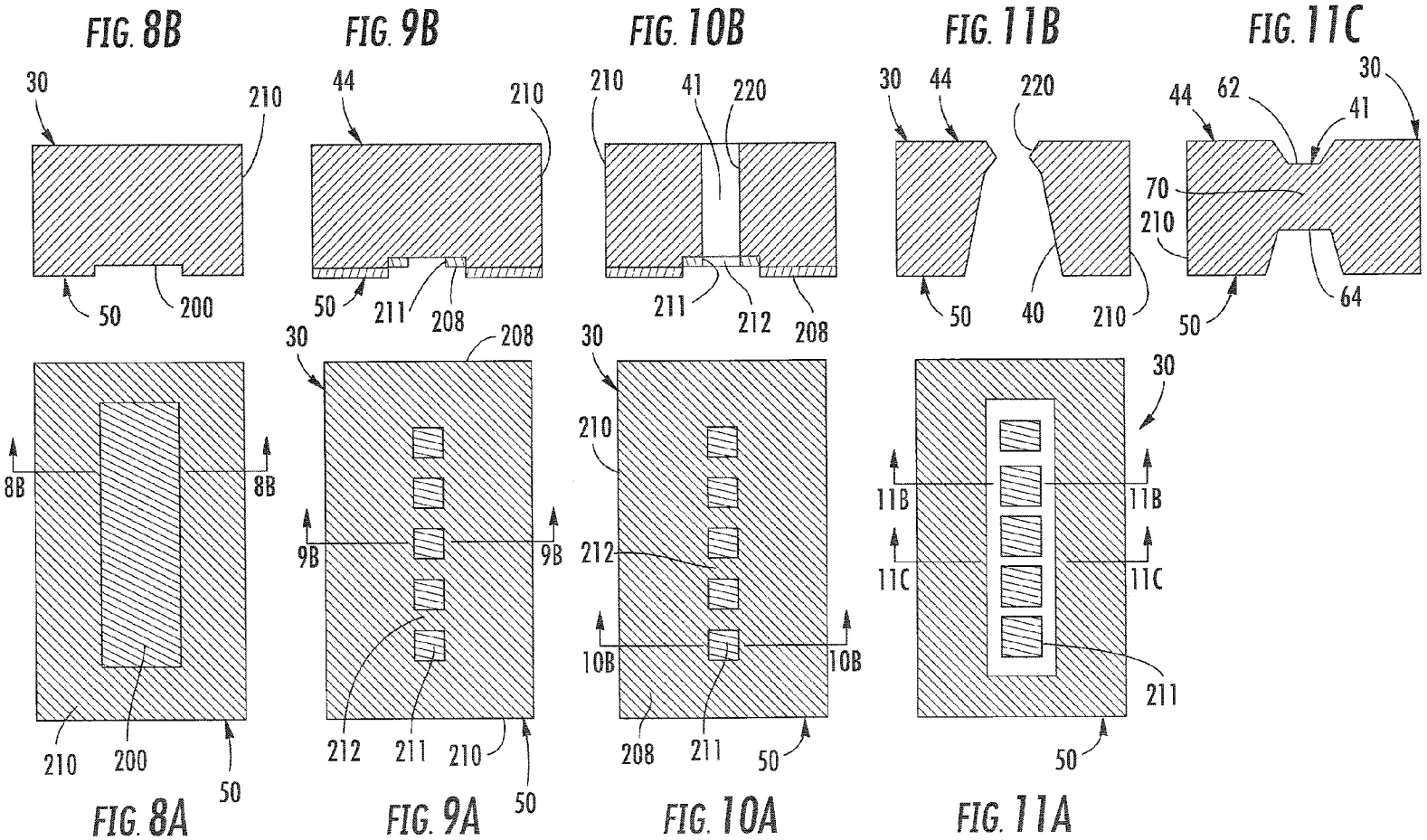
FIGS. 8A, 8B, 9A, 9B, 10A, 10B, 11A, 11B and 11C are sectional views illustrating the formation of a print head die according to the method shown in FIG. 7 according to an example embodiment.

FIGS. 8A and 8B illustrate the forming of a counter sink or trough 200 in a wafer or substrate 210 (serving as the main body or structure of die 30) pursuant to step 110 of method 100 outlined in FIG. 7. As shown by FIG. 8B, one or more material removal processes are employed to form trough 200 along side 50. Trough 200 substantially corresponds to the width W of slot 40 (shown in FIG. 4). According to one embodiment, trough 200 has a width W of about 200 micrometers. In other embodiments, trough 200 may have other dimensions. The axial length of trough 200 extends the full length of the desired length of slots 40 as well as the axial length of countersunk portions 56 at the ends of slots 40 (shown in FIG. 4). In other words, trough 200 extends past where the last via or end portion of slot 40 will reside. Trough 200 has a depth of between about 10 micrometers and about 100 micrometers. According to one embodiment, trough 200 may be formed by laser ablating followed by a wet etch, such as a tetramethylammonium hydroxide (TMAH) wet etch, to remove a laser debris. In other embodiments, trough 200 may be formed in other fashions, such as conventional lithography and dry or wet etch techniques.

FIGS. 9A and 9B illustrate the patterning of slots 40 and ribs 41 (shown in FIG. 6A) pursuant to step 120 method 100 (shown in FIG. 7). As shown by FIGS. 8A and 8B, a hard mask 208 for the subsequent formation of ribs 41 is formed. Hard mask 208 includes openings 211 which are separated by bridging portions 212. Each bridging portion 212 has a length and a width corresponding to the length and the width of the ribs 41 to be formed (shown in FIGS. 4 and 5). It is to be noted that final width and dimensions may vary dependent on length of wet etch and nature of dry etch process. In one embodiment, each bridging portion 212 has a length of approximately 200 micrometers and a width of between about 50 micrometers and 100 micrometers. In other embodiments, bridging portion 212 may have other dimensions.

According to one embodiment, hard mask 208 is formed by depositing one or more materials on side 50 of die 30 and substrate 210 that are laser ablatable yet resistant to the dry etchant to be used to remove portions of substrate 210 to deepen trough 200 about hard mask 108. According to one embodiment, hard mask 208 is formed by depositing layers of approximately 200 Å Å of Ti and 6000 Å of AlCu or Al. The deposited layers are laser ablated or laser patterned down to or into substrate 212 form openings 211, leaving bridging portion of 212. In other embodiments, hard mask 208 may be formed from other materials, may have other dimensions and may be formed in other fashions.

FIGS. 10A and 10B illustrate the dry etching of breakthroughs through substrate 210 between ribs 41 pursuant to step 130 of method 100 (shown in FIG. 7). As shown in FIG. 10B, additional material or portions of substrate 104 through openings 211 of hard mask 208 are removed to form breakthrough 220. Once the breakthrough 220 has been completed, hard mask 208 is also removed. According to one embodiment, a dry etchant, such as $SF_6$ and $C_4F_8$, is applied to etch those portions of substrate 210 through openings 211 and not protected by hard mask 208. The dry etching process is controlled so as to extend completely through substrate 210.

FIGS. 11A, 11B and 11C illustrate the recessing of ribs 41 using a wet etch pursuant to step 140 of method 100 (shown in FIG. 7). As shown by FIG. 11C, the wet etching results in edge 62 of rib 41 being recessed from side 44 print head die 30. As noted above, in one embodiment, edge 62 is recessed from side 44 by least about 30 μm and nominally about 50 μm. Edge 64 of rib 41 is also recessed from side 50 of print head die 30. As shown by FIG. 11B, during etching process to recessed rib 41, breakthrough 220 so as to widen slot 40 and it's opening along side 44.

As noted above, the etching process used to recessed rib 41 is controlled such that recesses 66, 68 (shown in FIG. 6A) and extending into edges 62 and 64 do not form surfaces facing in a direction of a center point 70 of the rib 41. According to one embodiment, a wet etchant, such as TMAH, is also applied to for approximately 30 minutes to recess each of ribs 41. In other embodiments, other wet etchants and other etching parameters may be employed.

Overall, method 100 allows ribs 41 to be formed and recessed from at least side 44 in a quick and inexpensive manner. The recessing of ribs 41 from at least side 44 is achieved with a reduced reliance upon more expensive and complicated processes or material removal techniques along side 44. In particular, breakthrough 220 controls and directs the flow of wet etchant. As a result, the flow of wet etchant has a greater velocity and is more focused. Consequently, the recessing of ribs 41 occurs at a faster rate. Because the etching rate and recessing rate of ribs 41 is increased, the time otherwise needed to recess ribs 41 to a desired extent from at least side 44 may be shortened. Because the time at which substrate 210 is exposed to the etchant is reduced, less material from other portions of substrate 210 are etched away. As a result, less material along slot 40 is etched away, decreasing the width W (shown in FIG. 4) of slots 40. By decreasing the width W of slots 40, the pitch of slots 40 may be increased for greater printing density.

Moreover, by reducing the etching time, recesses 66 and 68 (shown in FIG. 6A) may be formed. As noted above, recesses 66 and 68 do not include surfaces facing away from the associated openings 70 of such recesses or facing towards center point 70. Consequently, recesses 66 and 68 are less likely to trap air. This may be especially beneficial with respect to recess 66 which may face in a downward direction.

By way of contrast, FIG. 6B illustrates a rib 41' formed using the same general method 100 without step 130 in which breakthrough 220 is formed. Without breakthrough 220, achieving the desired recessing of rib 41' from side 44 may involve a greater wet etching time. This longer period of time for etching results in the formation of recesses 66' and 68'. Recesses 66' and 68' are generally diamond-shaped having surfaces 92, 94 which face away from opening 71 and faced towards center point 70 of rib 41'. In particular, surfaces 92 and 94 of recess 66' face away from edge 62'. Surfaces 90 to 94 of recess 68' face away from edge 64'. Surfaces 92 and 94 form cavities or volumes where air or air bubbles may become trapped. This may reduce print quality. In addition, the prolonged etching time may have other disadvantages as well such as widening of slots 40 and increasing fabrication time and cost.

Figures 12A, 12B, 13A, 13B, 13C, 14A, 14B, 14C:
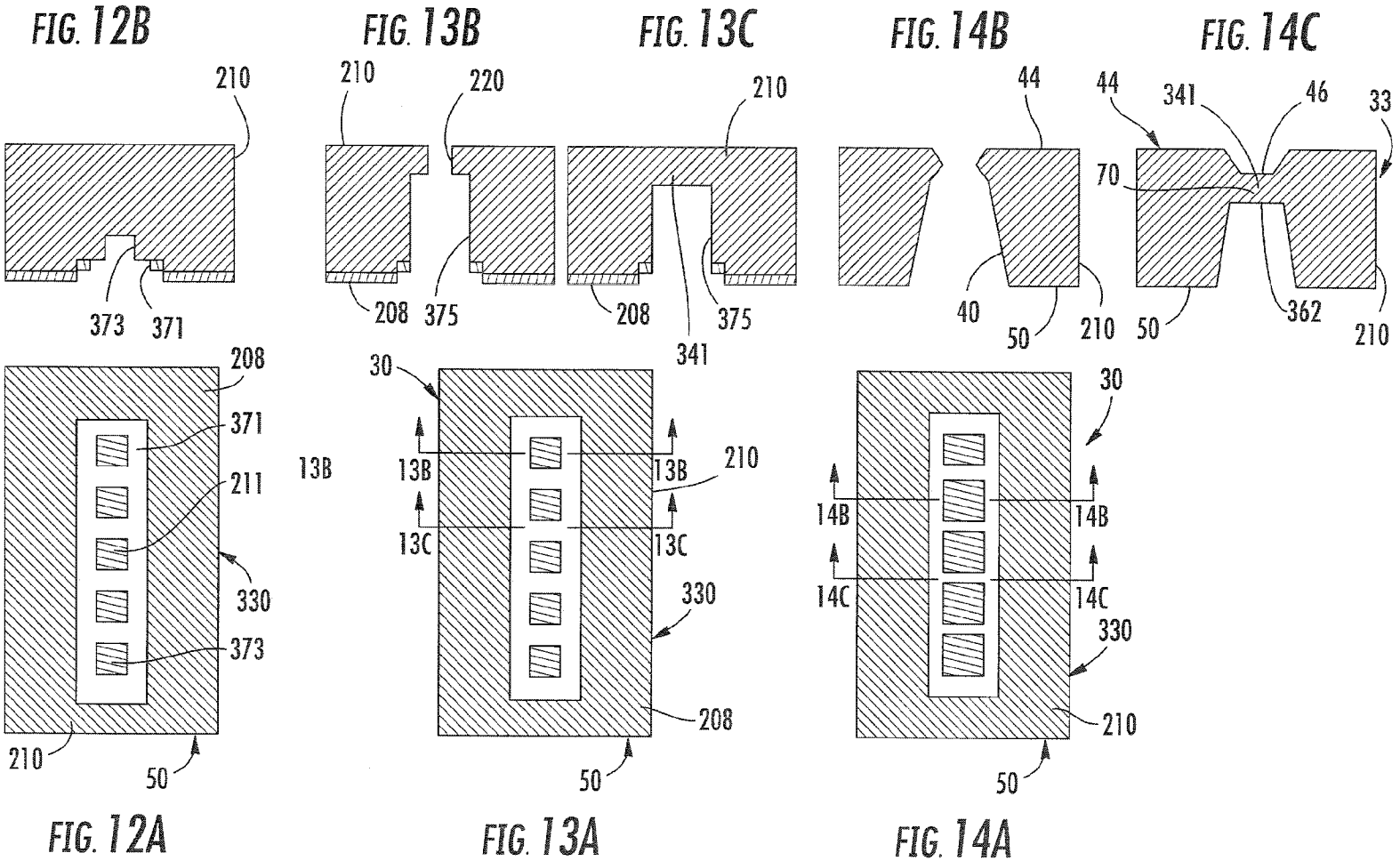
FIGS. 12A, 12B, 13A, 13B, 13C, 14A, 14B and 14C are sectional views illustrating the formation of another embodiment of a print head die according to an example embodiment.

FIGS. 12-14 illustrate the forming of print head die 330 (shown in FIG. 14C). Print head die 330 is similar to print head die 30 except that printed die 330 includes ribs 341 in place of ribs 41. Ribs 341 are similar to ribs 41 except that ribs 341 include edges 362 spaced or recessed from side 50 of the die 330 by a greater distance as compared to edge 62 of each of ribs 41. Like ribs 41, ribs 341 include recesses 66 and 68 (shown in FIG. 6A). As a result, ribs 362 have a configuration less susceptible to the trapping of air bubbles. In addition, like ribs 41, ribs 341 are recessed from side 44 for enhanced print quality.

Ribs 341 and slots 41 (shown in FIG. 14A) are formed by a method similar to method 100. In particular, as with the forming of ribs 41, ribs 341 of form by initially forming counter sinks in substrate 210 and by patterning slots and ribs on substrate 210 as outlined in steps 110 and 120 and FIG. 7 and a shown in FIGS. 8 and 9. However, unlike the method 100 of forming ribs 41, the method used to form ribs 341 includes the additional step shown in FIG. 12. As shown in FIGS. 12A and 12B, an additional area 371 of hard mask 208 is removed about openings 211. In addition, an additional countersink growth return 73 extending into substrate 210 is formed. This results multiple stepped surfaces of substrate 210 being exposed through hard mask 208. In one embodiment, area 371 and countersink 3 and 73 may be formed using laser ablation. In yet another embodiment, other mature removal techniques may be used.

As shown in FIGS. 13A, 13B and 13C, material or portions of substrate 210 exposed through hard mask 208 are removed to form breakthrough 220. As shown by FIGS. 13B and 13C, due to the increased exposure of substrate 210, an enlarged countersink 375 is formed opposite to breakthroughs 220 and opposite to ribs 341. Once the breakthrough 220 has been completed, hard mask 208 is also removed. According to one embodiment, a dry etchant, such as $SF_6$ and $C_4F_8$, is applied to etch those portions of substrate 210 through openings 211 and not protected by hard mask 208. The dry etching process is controlled so as to extend completely through substrate 210.

FIGS. 14A, 14B and 14C illustrate the recessing of ribs 341 using a wet etch similar to step 140 of method 100 (shown in FIG. 7). As shown by FIG. 14C, the wet etching results in edge 362 of rib 341 being recessed from side 44 print head die 330. As noted above, in one embodiment, edge 362 is recessed from side 44 by least about 100 μm and nominally about 175 Edge 64 of rib 341 is also recessed from side 50 of print head die 330. As shown by FIG. 14B, during etching process to recessed rib 341, breakthrough 220 so as to widen slot 40 and its opening along side 44.

As with rib 41, the etching process used to recessed rib 341 is controlled such that recesses 66, 68 (shown in FIG. 6A) and extending into edges 362 and 64 do not form surfaces facing in a direction of a center point 70 of the rib 341. According to one embodiment, a wet etchant, such as TMAH, is also applied to for approximately 30 minutes to recess each of ribs 341. In other embodiments, other wet etchants and other etching parameters may be employed.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a print head die having a first side, configured to face a fluid reservoir, and a second opposite side, the print head die comprising:

a fluid feed slot through the die; and ribs extending across the slot, wherein each of the ribs has an edge facing the second side and recessed from the second side of the die, the edge having a first triangular notch, wherein the triangular notch comprises first and second side surfaces converging at a point spaced from opposite sides of the fluid feed slot.

2. The apparatus of claim 1, wherein the triangular notch has first and second sides extending at an angle of between about 50 degrees and 60 degrees with respect to the first side of the die.

3. The apparatus of claim 1, wherein the fluid feed slot has side surfaces formed from a material homogenous with a remainder of the die.

4. The apparatus of claim 1, wherein the fluid feed slot has uncoated side surfaces formed from silicon.

5. The apparatus of claim 1, wherein each of the ribs has a second edge, the second edge having a second triangular notch.

6. The apparatus of claim 1, wherein the first and second side surfaces extend from a perimeter of the rib and converge at the point.

7. The apparatus of claim 6, wherein the first and second side surfaces extend at angle of between about 50 degrees and about 60 degrees with respect to the second side of the die.

8. The apparatus of claim 6, wherein the first and second side surfaces extend at angle of about 54.7 degrees with respect to the second side of the die.

9. The apparatus of claim 6, wherein the die (30) has uncoated silicon surfaces adjacent and within the slot (40).

10. The apparatus of claim 1, wherein the ribs are recessed from the second side of the die.

11. The apparatus of claim 1 further comprising a fluid reservoir bonded to the die on the first side of the die.

12. The apparatus of claim 11 further comprising an orifice plate coupled to the die on the second side of the die.

13. The apparatus of claim 1, wherein each rib has a width of less than or equal to about 150 micrometers.

14. A method comprising:

dry etching from a first side of a wafer a series of spaced openings completely through the wafer and separated by ribs, wherein the first side is to face a fluid reservoir and wherein the series of spaced openings form a fluid feed slot; and wet etching in the wafer from a second opposite side (44) of the wafer to recess the ribs from the second side, wherein the wet etching forms a triangular notch at an edge of the ribs facing a second side, the triangular notch having first and second side surfaces extending from a perimeter of the rib and converging at a point spaced from opposite sides of the fluid feed slot.

15. The method of claim 14 further comprising removing portions of the ribs adjacent to the first side of the wafer.

16. The method of claim 14 further comprising laser cutting the first side of the wafer to remove portions of the ribs adjacent the first side of the wafer.

17. The method of claim 14 further comprising forming a dry etch mask on the wafer defining a series of spaced openings prior to the dry etching step.

18. The method of claim 17, wherein forming the dry etch mask comprises:

blanket coating a layer on the wafer; and laser patterning the layer.

19. The method of claim 14, wherein the wafer is silicon and wherein the openings through the wafer are bordered by uncoated silicon surfaces during the wet etching.

20. The method of claim 14, wherein the first and second side surfaces extend at an angle of between about 50 degrees and about 60 degrees with respect to the second side of the die.

* * * * *